US010511927B2

(12) United States Patent
Kitazawa

(10) Patent No.: US 10,511,927 B2
(45) Date of Patent: Dec. 17, 2019

(54) SOUND SYSTEM, CONTROL METHOD OF SOUND SYSTEM, CONTROL APPARATUS, AND STORAGE MEDIUM

(71) Applicant: CANON KABUSHIKI KAISHA, Tokyo (JP)

(72) Inventor: Kyohei Kitazawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 109 days.

(21) Appl. No.: 15/724,996

(22) Filed: Oct. 4, 2017

(65) Prior Publication Data

US 2018/0115848 A1 Apr. 26, 2018

(30) Foreign Application Priority Data

Oct. 25, 2016 (JP) ..... 2016-208844

(51) Int. Cl.

| | |
|---|---|
| ***H04S 7/00*** | (2006.01) |
| ***H04R 3/00*** | (2006.01) |
| ***H04R 1/40*** | (2006.01) |
| ***H04R 5/02*** | (2006.01) |
| ***H04R 5/04*** | (2006.01) |
| ***H04R 29/00*** | (2006.01) |
| ***H04S 3/00*** | (2006.01) |
| *H04R 5/027* | (2006.01) |

(52) U.S. Cl.

CPC ..... *H04S 7/301* (2013.01); *H04R 1/406* (2013.01); *H04R 3/005* (2013.01); *H04R 5/02* (2013.01); *H04R 5/04* (2013.01); *H04R 29/002* (2013.01); *H04S 3/008* (2013.01); *H04S 7/303* (2013.01); *H04R 5/027* (2013.01); *H04S 2400/01* (2013.01); *H04S 2400/11* (2013.01); *H04S 2400/15* (2013.01)

(58) Field of Classification Search

CPC ..... H04S 2400/15

See application file for complete search history.

(56) References Cited

U.S. PATENT DOCUMENTS 5,714,997 A * 2/1998 Anderson ..... G02B 27/017 348/39

7,085,387 B1 * 8/2006 Metcalf ..... H04R 5/00 369/5

(Continued)

FOREIGN PATENT DOCUMENTS

JP 2014-072708 A 4/2014

*Primary Examiner* — Kile O Blair

(74) *Attorney, Agent, or Firm* — Canon U.S.A., Inc. IP Division

(57) ABSTRACT

A sound system includes an acquisition unit configured to acquire a sound collection signal that includes sound collected from a sound collection target area, a plurality of generation units configured to generate a plurality of sound signal corresponding to a plurality of divided areas included in the sound collection target area based on a sound collection signal acquired by the acquisition unit, a determination unit configured to determine by which generation unit from among the plurality of generation units a sound signal corresponding to each of the plurality of divided areas is to be generated, and a control unit configured to control the plurality of generation units so that the sound signal corresponding to each of the divided areas is generated by a generation unit according to determination of the determination unit.

21 Claims, 13 Drawing Sheets

(56) References Cited

U.S. PATENT DOCUMENTS

2002/0131580 A1* 9/2002 Smith ..... H04R 3/005
379/387.01
2014/0369506 A1* 12/2014 Arrasvuori ..... G01S 3/8083
381/17

* cited by examiner

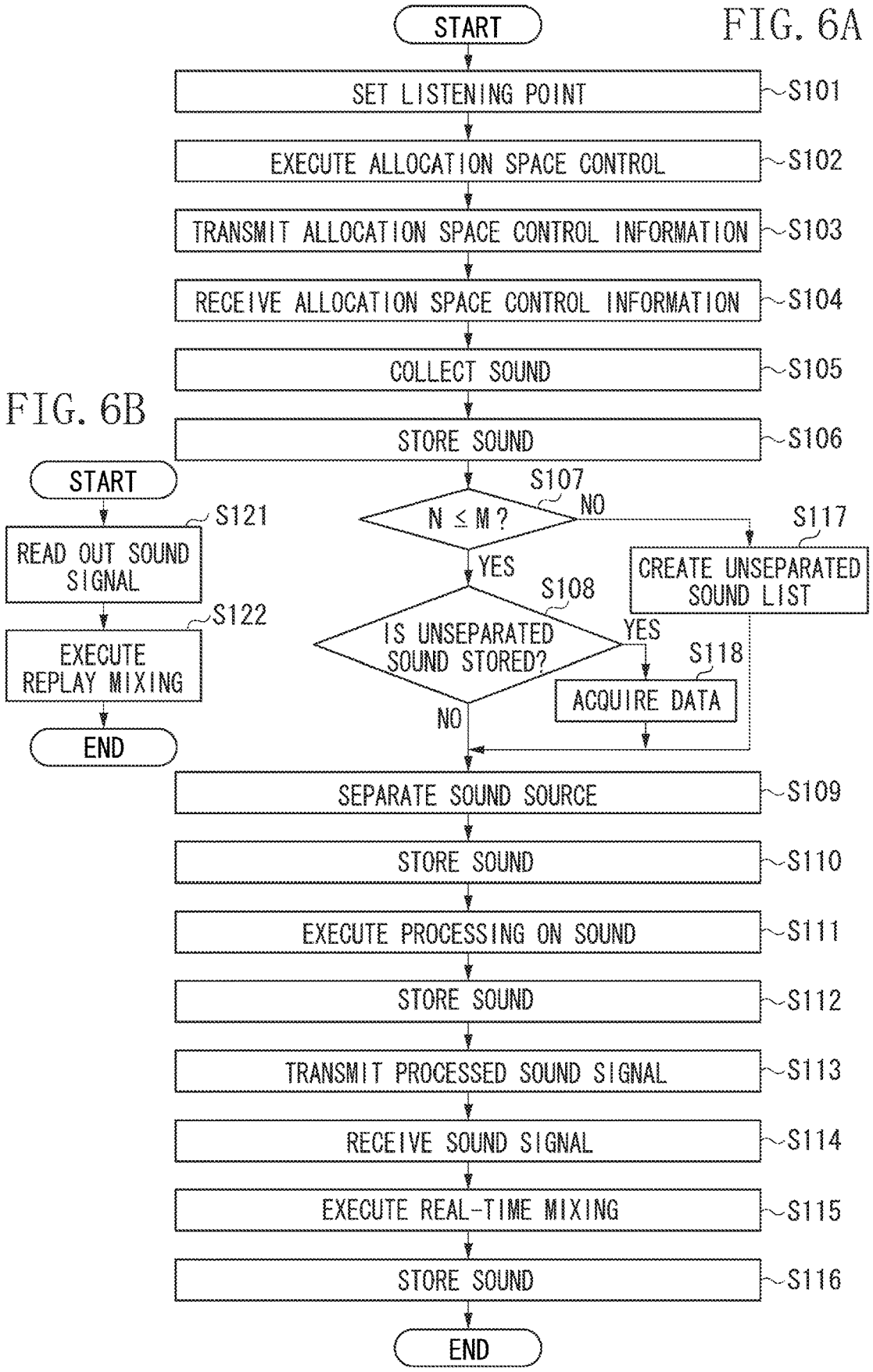
FIG. 6A
START
SET LISTENING POINT
S101
EXECUTE ALLOCATION SPACE CONTROL
S102
TRANSMIT ALLOCATION SPACE CONTROL INFORMATION
S103
RECEIVE ALLOCATION SPACE CONTROL INFORMATION
S104
COLLECT SOUND
S105
STORE SOUND
S106
S107
N ≤ M ?
NO
YES
S117
CREATE UNSEPARATED SOUND LIST
S108
IS UNSEPARATED SOUND STORED?
YES
S118
ACQUIRE DATA
NO
SEPARATE SOUND SOURCE
S109
STORE SOUND
S110
EXECUTE PROCESSING ON SOUND
S111
STORE SOUND
S112
TRANSMIT PROCESSED SOUND SIGNAL
S113
RECEIVE SOUND SIGNAL
S114
EXECUTE REAL-TIME MIXING
S115
STORE SOUND
S116
END
FIG. 6B
START
S121
READ OUT SOUND SIGNAL
S122
EXECUTE REPLAY MIXING
END

SOUND SYSTEM, CONTROL METHOD OF SOUND SYSTEM, CONTROL APPARATUS, AND STORAGE MEDIUM

BACKGROUND OF THE INVENTION

Field of the Invention

The present invention relates to a sound system, a control method of the sound system, a control apparatus, and a storage medium.

Description of Related Art

There has been known a technique of dividing a space into a plurality of areas and acquiring sound of each of the divided areas (see Japanese Patent Application Laid-Open No. 2014-72708).

However, when sounds of divided areas are to be processed and broadcasted through real-time processing, data may be lost and the sound may be discontinued because processing or transmission of the sound cannot be executed in real-time.

SUMMARY OF THE INVENTION

According to an aspect of the present invention, a sound system includes an acquisition unit configured to acquire a sound collection signal that includes sound collected from a sound collection target area, a plurality of generation units configured to generate a plurality of sound signals corresponding to a plurality of divided areas included in the sound collection target area based on the sound collection signal acquired by the acquisition unit, a determination unit configured to determine by which generation unit from among the plurality of generation units a sound signal corresponding to each of the plurality of divided areas is to be generated, and a control unit configured to control the plurality of generation units so that the sound signal corresponding to each of the divided areas is generated by a generation unit according to determination of the determination unit.

Further features of the present invention will become apparent from the following description of exemplary embodiments with reference to the attached drawings.

BRIEF DESCRIPTION OF THE DRAWINGS

FIGS. 6A and 6B are flowcharts illustrating processing executed by the sound system.

DESCRIPTION OF THE EMBODIMENTS

Figure 1:
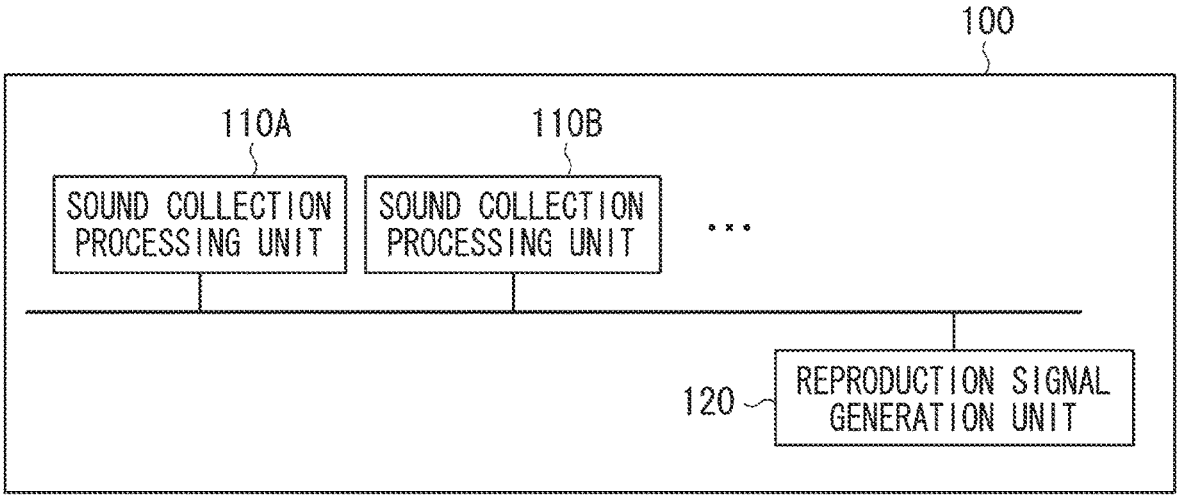
FIG. 1 is a block diagram illustrating a configuration of a sound system.

Exemplary embodiments of the present invention will be described below with reference to the appended drawings. The exemplary embodiments described below are not intended to limit the present invention. The combinations of features described in the exemplary embodiments are exemplary solutions of the present invention. Further, the exemplary embodiments will be described while the same components are denoted by the same reference numerals.

In a first exemplary embodiment, a configuration which enables real-time processing to be reliably executed by smoothing the processing by adjusting an allocation space allocated to each microphone array based on a listening point will be described.

<Sound System>

FIG. 1 is a block diagram illustrating a configuration of a sound system 100 according to an exemplary embodiment (first embodiment) of the present invention. The sound system 100 includes a plurality of sound collection processing units 110 (110A, 110B, etc.), and a reproduction signal generation unit 120. The plurality of sound collection processing units 110 and the reproduction signal generation unit 120 can send and receive data to/from each other via a transmission path which can be a wired or a wireless path. Each sound collection processing unit 110 is a device that collects sound from an allocated physical area (allocated space) via a microphone array. The reproduction signal generation unit 120 controls the spatial areas allocated to the sound collection processing units 110, and also receives sound from each of the sound collection processing units 110 and generates a reproduction signal by executing a mixing process.

The sound system 100 according to the present exemplary embodiment includes a plurality of sound collection processing units 110A, 110B, . . . , and so on. In the present specification, these sound collection processing units 110A, 110B, . . . , and so on are collectively described as the sound collection processing unit(s) 110. Further, alphabet characters "A", "B", . . . , and so on are applied to the reference numerals of below-described constituent elements of the sound collection processing units 110, so as to identify to which of the sound collection units 110A, 110B, . . . , and so on a below-described constituent element belongs. For example, a microphone array 111A is a constituent element of the sound collection processing unit 110A, and a sound source separation unit 112B is a constituent element of the sound collection processing unit 110B. A transmission path between the sound collection processing units 110 and the reproduction signal generation unit 120 is realized with a dedicated communication path such as a local area network (LAN), but communication there between may be performed via a public communication network such as the Internet.

The plurality of sound collection processing units 110 is arranged in such a manner that at least a part of a spatial range (sound collection area) where one sound collection processing unit 110 can collect sound overlaps with a spatial range where another sound collection processing unit 110 can collect sound. Herein, a sound collectable space, i.e., a spatial range where one sound collection processing unit 110 can collect sound is determined by directionality or sensitivity of a microphone array described below. For example, a range where sound can be collected at a predetermined signal-to-noise (S/N) ratio or more can be determined as a sound collectable space. As used herein signal-to-noise ratio (S/N) refers to a ratio of an actual sound signal (or power level of an electrical signal) to a noise signal, which may be measured in well-known units such as decibels (dB). The S/N could also be measured as ratio of sound pressure to noise. The noise is, for example, environmental noise, or electric noise, thermal noise, etc.

<Sound Collection Processing Unit>

Figure 2:
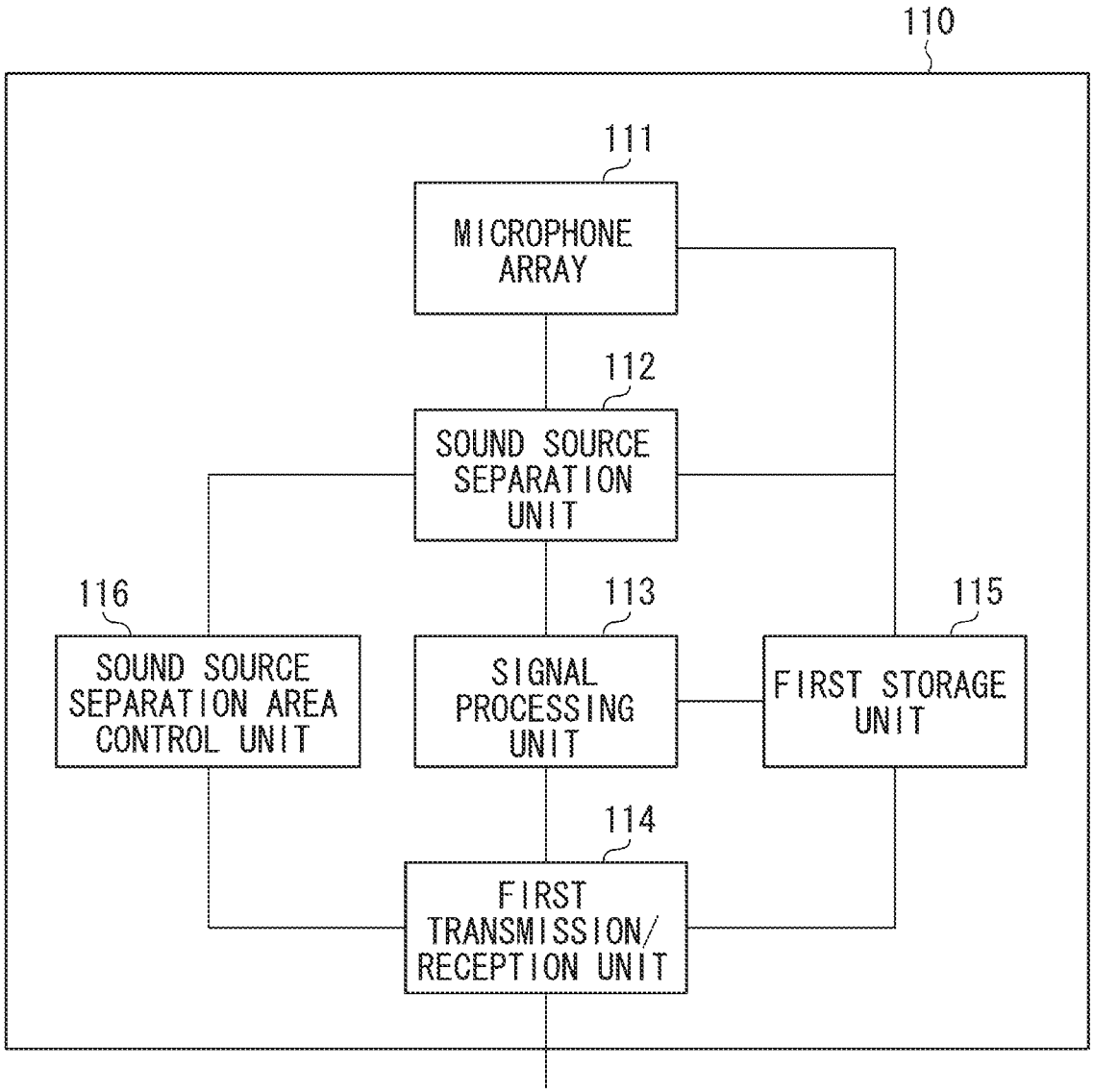
FIG. 2 is a block diagram illustrating a configuration of a sound collection processing unit.

FIG. 2 is a block diagram illustrating a configuration of the sound collection processing unit 110. The sound collection processing unit 110 includes a microphone array 111, a sound source separation unit 112, a signal processing unit 113, a first transmission/reception unit 114, a first storage unit 115, and a sound source separation area control unit 116.

The microphone array 111 is configured of a plurality of microphones. The microphone array 111 collects sound from a predetermined area of physical space allocated to the sound collection processing unit 110 via the microphones. As used herein, "a predetermined area of physical space", which may also be referred to as "space", refers to a limited extent of space in on, two or three dimensions (distance, area or volume) in which sound events occur and have relative position and direction. Because each of the microphones that constitute the microphone array 111 collects sound, as a whole, the sound acquired through the sound collection by the microphone array 111 is a multi-channel sound collection signal consisting of a plurality of sound signals collected by the respective microphones. The microphone array 111 executes analog/digital (A/D) conversion of the sound collection signal and then outputs the converted sound collection signal to the sound source separation unit 112 and the first storage unit 115.

The sound source separation unit 112 includes a signal processing device such as a central processing unit (CPU). When a space allocated to the sound collection processing unit 110 for sound collection processing is divided into N-pieces of areas (N>1) (hereinafter, referred to as "divided area"), the sound source separation unit 112 executes sound source separation processing for separating the signal received from the microphone array 111 into the sound of each of the divided areas. As described above, the signal received from the microphone array 111 is a multi-channel sound collection signal consisting of a plurality of pieces of sound collected by the respective microphones. Thus, based on a positional relationship between the microphones that constitute the microphone array 111 and a divided area as a sound collection target, phase control and weight addition are executed on the sound signals collected by the microphones, so that sound of an arbitrary divided area can be reproduced. The above-described sound source separation processing is executed by each of the sound source separation units 112 of the plurality of sound collection processing units 110. In other words, based on the sound collection signals acquired by the microphone arrays 111, the plurality of sound collection processing units 110 generates a plurality of sound signals corresponding to the plurality of divided areas in the sound collection space.

The sound source separation processing is executed at each processing frame, i.e., at a predetermined time interval. For example, the sound source separation unit 112 executes beamforming processing at a predetermined time interval. A result of the sound source separation processing is output to the signal processing unit 113 and the first storage unit 115. Herein, an allocation space, a division number N, and a processing order are set based on a control signal received from the sound source separation area control unit 116 described below. When the set division number N is greater than a predetermined number M, based on a preset processing order, the sound source separation processing is not executed on the divided areas subsequent to the M-th divided area, and unprocessed frame numbers and unprocessed divided areas are managed as an unseparated sound list. The sound listed in the unseparated sound list is processed at a frame with a division number N set to have a value smaller than the predetermined number M. The processed item is deleted from the unseparated sound list. As described above, a priority order is applied to the divided area, and processing on the divided area with a lower priority order is suspended when the division number N is greater than the predetermined number M, thereby ensuring real-time characteristics of the processing. Further, because the processing is executed in an order from a divided area with the highest priority, important sound can be reproduced in real time.

The signal processing unit 113 is configured of a processing device such as a CPU. The signal processing unit 113 executes processing on the sound signal of each time and each divided area according to a control signal of a processing order of the sound signal input thereto. Examples of the processing executed by the signal processing unit 113 include delay correction processing for correcting an effect caused by a distance between the divided area and the corresponding sound collection processing unit 110, gain correction processing, and echo removal processing. The processed signal is output to the first transmission/reception unit 114 and the first storage unit 115.

The first transmission/reception unit 114 receives and transmits the processed sound signal of each divided area. Further, the first transmission/reception unit 114 receives allocation of the allocation space from the reproduction signal generation unit 120 and outputs the allocation to the sound source separation area control unit 116. Allocation of the allocation space will be described below in detail.

The first storage unit 115 stores all of the sound signals received at each of the processing steps. The first storage unit 115 is realized by a storage device such as a hard disk drive (HDD), a solid state drive (SSD), or a memory (e.g., flash memory drive).

Based on the received information about the allocation of the allocation space and a listening point, the sound source separation area control unit 116 outputs a signal for controlling a divided area, on which sound source separation is executed, and a signal for controlling a processing order.

<Reproduction Signal Generation Unit>

Figure 3:
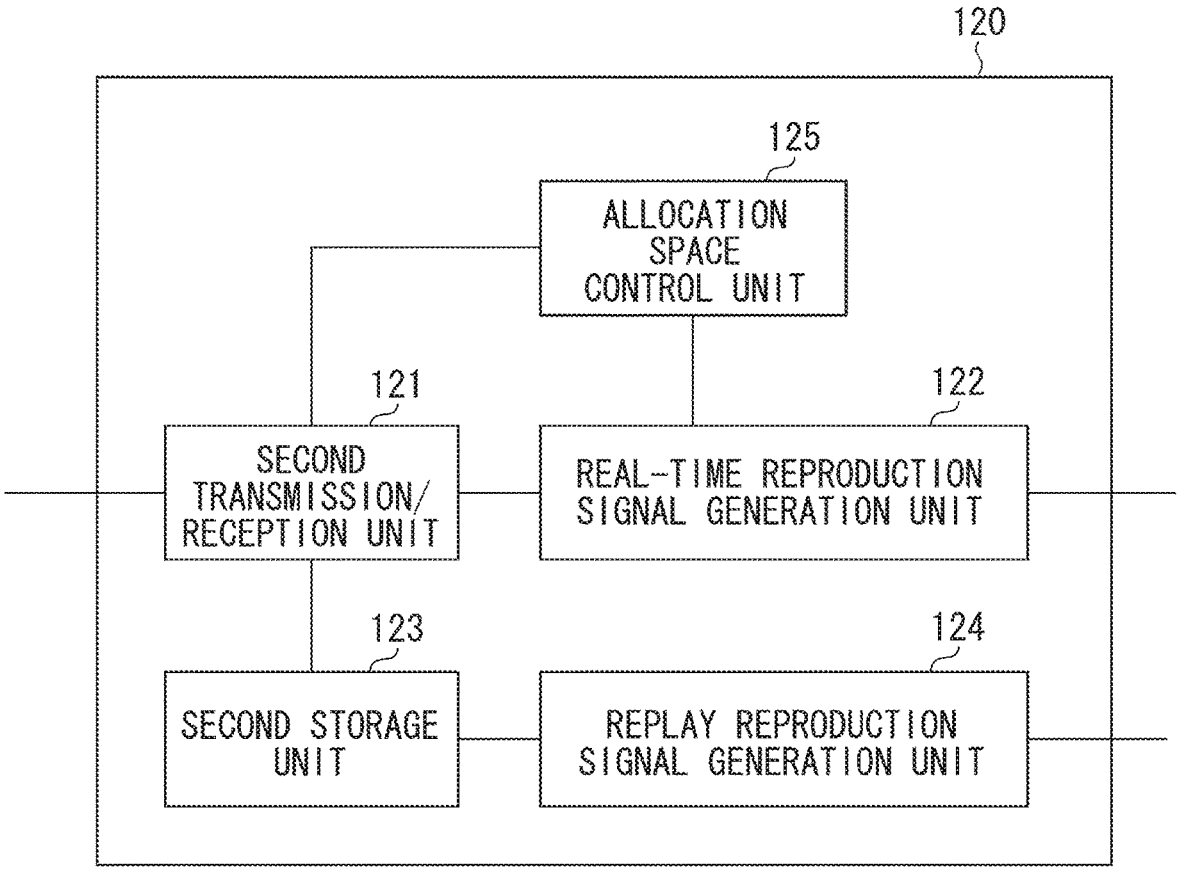
FIG. 3 is a block diagram illustrating a configuration of a reproduction signal generation unit.

FIG. 3 is a block diagram illustrating a configuration of the reproduction signal generation unit 120. The reproduction signal generation unit 120 includes a second transmission/reception unit 121, a real-time reproduction signal generation unit 122, a second storage unit 123, a replay reproduction signal generation unit 124, and an allocation space control unit 125.

The second transmission/reception unit 121 receives a sound signal output from the first transmission/reception unit 114 of the sound collection processing unit 110 and outputs the sound signal to the real-time reproduction signal generation unit 122 and the second storage unit 123. Further, the second transmission/reception unit 121 receives the allocation of the allocation space from the below-described allocation space control unit 125, and outputs the allocation to the plurality of sound collection processing units 110. In other words, the second transmission/reception unit 121 respectively notifies the plurality of sound collection processing units 110 of divided areas allocated thereto.

The real-time reproduction signal generation unit 122 executes mixing of sound of each divided area within a predetermined time after sound collection, and generates and outputs a real-time reproduction signal. For example, the real-time reproduction signal generation unit 122 acquires a virtual listening point and a direction of a virtual listener (hereinafter, simply referred to as "listening point" and "direction of a listener (listening direction)") in a space which are changed according to time and information about a reproduction environment from the outside, and executes mixing of the sound source. For example, a position of the listening point and a listening direction are specified when an operation unit 996 of the reproduction signal generation unit 120 receives an operation input performed by the user. However, the configuration is not limited to the above, and at least any one of the listening point and a listening direction may be specified automatically. The reproduction environment refers to a reproduction device such as a speaker (e.g., a stereo speaker, a surround sound speaker, or a multi-channel speaker) or headphones which reproduces the signal generated by the real-time reproduction signal generation unit 122. In other words, in the mixing processing of the sound source, the sound signal of each divided area is combined or converted according to the environment such as a number of channels of the reproduction device. Further, information about a listening point and a direction of the listener is output to the allocation space control unit 125.

The second storage unit 123 is a storage device such as an HDD, an SSD, or a memory, and a sound signal of each divided area received by the second transmission/reception unit 121 is stored therein together with the information about the divided area and the time.

When replay reproduction is requested, the replay reproduction signal generation unit 124 acquires data of corresponding time from the second storage unit 123, and executes processing similar to the processing executed by the real-time reproduction signal generation unit 122 to output the data.

The allocation space control unit 125 controls allocation spaces of the plurality of sound collection processing units 110. In other words, the allocation space control unit 125 determines by which sound collection processing unit 110 from among the plurality of sound collection processing units 110 the sound signal corresponding to the divided area from among the plurality of divided areas in the sound collection space is to be generated. Then, the allocation space control unit 125 controls the plurality of sound collection processing units 110 in such a manner that a sound signal corresponding to the divided area is generated by the sound collection processing unit 110 according to the determination. FIGS. 4A, 4B, 4C, and 4D are diagrams illustrating examples of allocation space control.

Figure 4A:
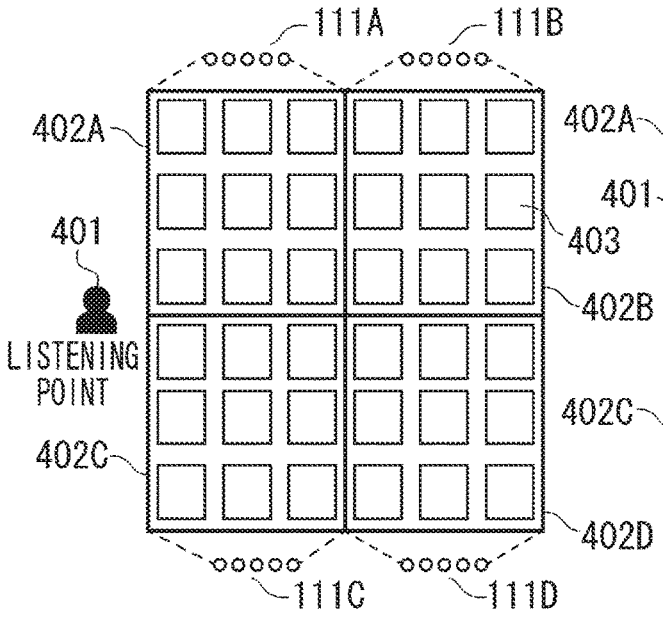
FIGS. 4A, 4B, 4C, and 4D are diagrams illustrating examples of space allocation control.

For example, as illustrated in FIG. 4A, when a listening point 401 exists in the outside of a sound collection space (sound collection target area), allocation spaces 402A, 402B, 402C, to 402D are equally allocated to the microphone arrays 111A to 111D. The microphone arrays 111A to 111D are constituent elements of the sound collection processing units 110A to 110D, respectively; and the allocation spaces 402A to 402D are spaces allocated to the sound collection processing units 110A to 110D, respectively.

Herein, a plurality of small frames in each of the allocation spaces 402A, 402B, 402C and 402D represents a plurality of divided areas 403. In the examples illustrated in FIGS. 4A, 4B, 4C, and 4D, arrangement of the divided areas 403 is previously determined in such a manner that the entire sound collection target space is divided into six-by-six pieces of divided areas 403, and the divided areas 403 covered by each of the sound collection processing units 110 are determined by allocating the divided areas 403 to the sound collection processing units 110A to 110D. However, arrangement of the divided areas 403 does not have to be determined previously, and an allocation space may be divided into a plurality of divided areas as appropriate after the allocation spaces 402 are determined.

Figure 4B:
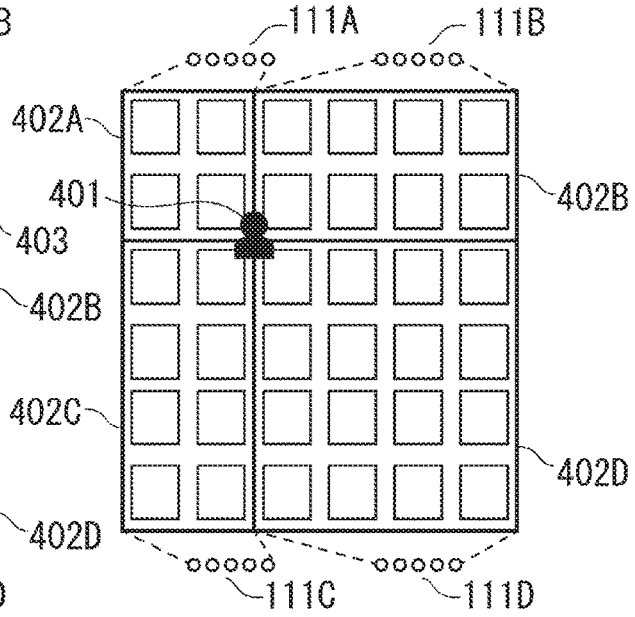
Figure 4C:
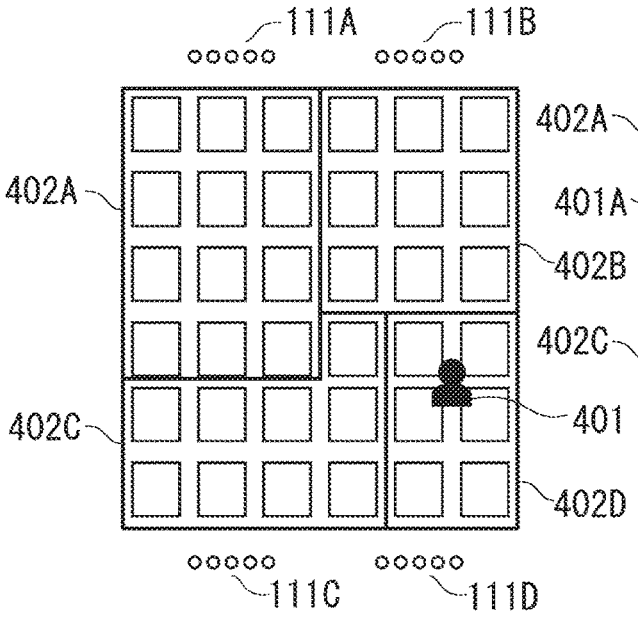

Subsequently, when the listening point 401 exists in the sound collection space as illustrated in FIG. 4B, the sound in the vicinity of the listening point 401 is important when the real-time reproduction signal is generated. Thus, in order to equally allocate the divided areas 403 in the vicinity of the listening point 401 to the plurality of sound collection processing units 110, as illustrated in FIG. 4B, the allocation space 402 is divided by making the listening point 401 at the center. The allocation space control unit 125 transmits information for notifying the sound collection processing units 110 that cover the divided areas 403 of the allocation spaces 402 allocated to the sound collection processing units 110. Further, the allocation space control unit 125 sets a processing order according to a distance from the listening point 401 and transmits the information about the processing order together with the aforementioned information to the sound collection processing units 110. For example, the processing order may be set in an order of first processing sound from a divided area 403 located at a shortest distance from the listening point 401, and progressively processing sound from divided areas 403 located at increasing distances from the listening point 403. The processing order may also be set differently, as in FIGS. 4C and 4D which will be described below.

As described above, in the present exemplary embodiment, because the allocation space 402 is allocated to the sound collection processing units 110 by dividing the entire sound collection target space based on a position of the listening point 401, the processing loads allocated to the sound collection processing units 110 can be smoothed according to a generation state of the sound. Further, the entire space where sound collection is executed by the plurality of microphone arrays 111 is divided by making the listening point 401 as the center or origin, and the plurality of microphone arrays 111 respectively controls the allocated spaces, and thus it is possible to reproduce stereoscopic sound. Further, the allocation space 402 allocated to the sound collection processing unit 110 is divided into divided areas 403, and the sound source separation processing and signal processing are executed by the sound collection processing unit 110 in an order of distance from the divided areas 403 to the listening point 401. Accordingly, sound of the divided areas 403 with the higher priority level existing in the vicinity of the listening point 401 can be reliably transmitted to the reproduction signal generation unit 120 without losing the real-time characteristics.

Figure 5:
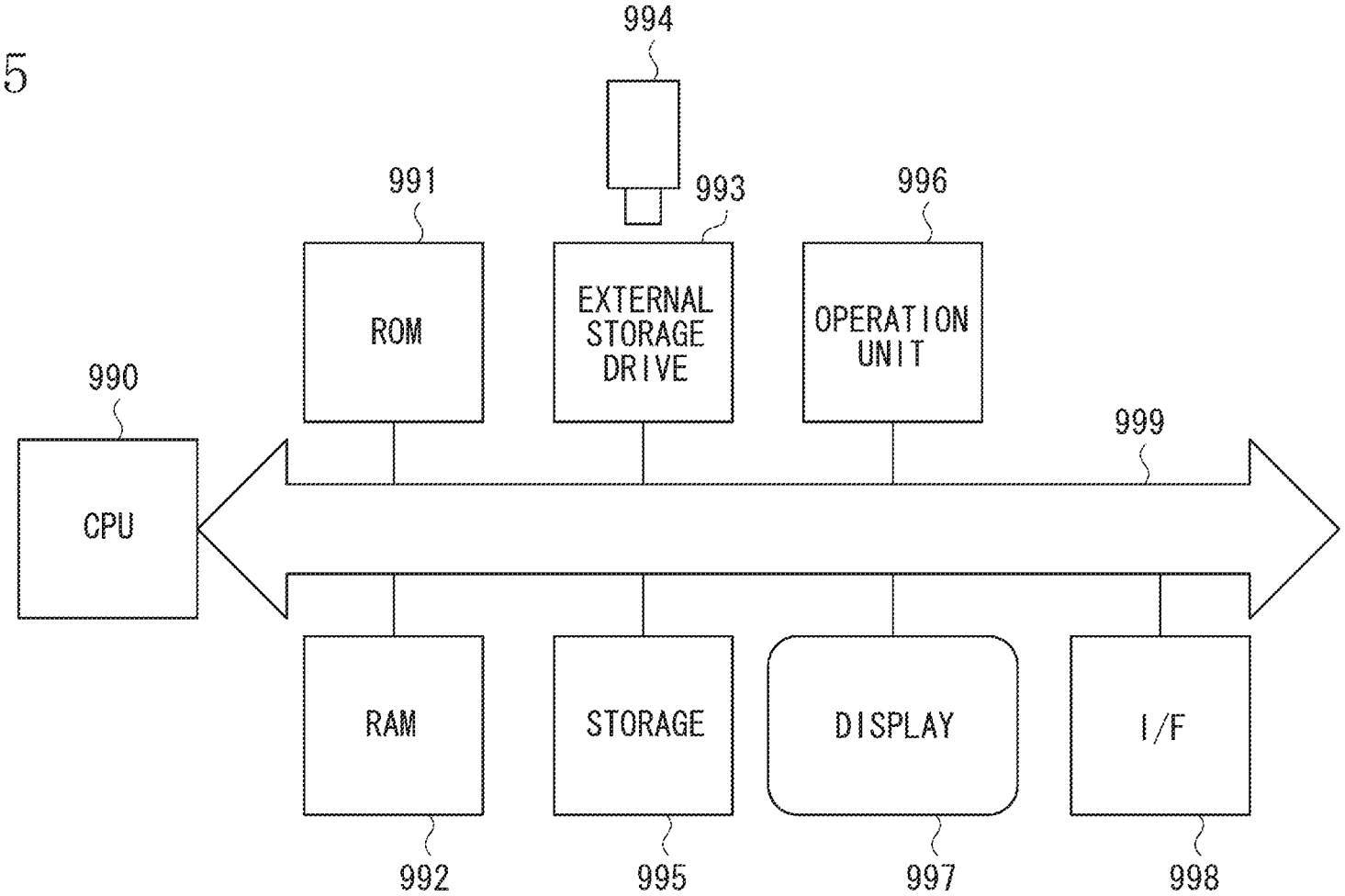
FIG. 5 is a block diagram illustrating an example of a hardware configuration of the reproduction signal generation unit.

FIG. 5 is a block diagram illustrating an example of a hardware configuration of the reproduction signal generation unit 120. For example, the reproduction signal generation unit 120 is realized by a personal computer (PC), an embedded system, a tablet terminal, or a smartphone.

In FIG. 5, a CPU 990 is a central processing unit which cooperatively operates with the other constituent elements based on a computer program and controls general operation of the reproduction signal generation unit 120. A read only memory (ROM) 991 is a read only memory which stores a basic program or data used for basic processing. A random access memory (RAM) 992 is a writable memory which functions as a work area of the CPU 990.

An external storage drive 993 realizes access to a storage medium, so that a computer program or data stored in a medium (storage medium) 994 such as a universal serial bus (USB) memory can be loaded onto a main system. A storage 995 is a device function as a large-capacity memory such as a solid state drive (SSD). Various computer programs and various types of data are stored in the storage 995.

An operation unit 996 is a device which accepts an input of an instruction or a command from a user. A keyboard, a pointing device, or a touch panel corresponds to the operation unit 996. A display 997 is a display device which displays a command input from the operation unit 996 or a response with respect to the input command output from the reproduction signal generation unit 120. An interface (I/F) 998 is a device which relays data exchange with respect to an external apparatus. A system bus 999 is a data bus that deals with a flow of data within the reproduction signal generation unit 120.

In addition, software that realizes a function equivalent to that of the above-described devices may be employed in place of the hardware devices.

<Signal Generation Processing>

FIGS. 6A and 6B are flowcharts illustrating procedures of the processing executed by the sound system 100 according to the present exemplary embodiment. FIG. 6A is a flowchart illustrating a procedure of the processing for collecting sound and generating a real-time reproduction signal (signal generation processing). These processing steps are sequentially executed at each frame. The frame in this application means a predetermined period of a sound signal.

First, in step S101, the real-time reproduction signal generation unit 122 of the reproduction signal generation unit 120 sets a listening point. The set listening point is output to the allocation space control unit 125 of the reproduction signal generation unit 120. For example, setting of the listening point can be executed based on an instruction input by the user or a setting signal transmitted from an external apparatus.

Next, in step S102, the allocation space control unit 125 determines allocation of spaces with respect to the plurality of sound collection processing units 110 and a processing order of divided areas. As described above, allocation of spaces or a processing order may be determined based on the position of the listening point. A determined allocation space, a division number N thereof, and control information about a processing order of divided areas (hereinafter, collectively called as "allocation space control information") are output to the second transmission/reception unit 121.

Next, in step S103, the second transmission/reception unit 121 of the reproduction signal generation unit 120 outputs allocation space control information. Then, in step S104, the first transmission/reception unit 114 of the sound collection processing unit 110 receives the allocation space control information. The received allocation space control information is output to the sound source separation area control unit 116.

Then, in step S105, sound collection is executed by the microphone array 111. As described above, the sound signal collected in step S105 is a multi-channel sound collection signal consisting of a plurality of pieces of sound collected by the microphones that constitute the microphone array 111. The sound signal converted through A/D conversion is output to the first storage unit 115 and the sound source separation unit 112.

Next, in step S106, the first storage unit 115 stores the sound received from the microphone array 111.

In step S107, the division number N input to the sound source separation area control unit 116 and a predetermined limit value M of the number of processing areas are compared to each other. If the division number N is greater than the limit value M (NO in step S107), the processing proceeds to step S117. In step S117, the sound source separation unit 112 of the sound collection processing unit 110 creates an "unseparated sound list". The (M+1)-th area and the subsequent areas in the processing order setting of the divided areas are not processed in the frame processing of this time, and the frame numbers and the area numbers are recorded in the unseparated sound list.

On the other hand, if the division number N is equal to or less than the limit value M (YES in step S107), the processing proceeds to step S108. In step S108, it is determined whether unseparated sound is listed in the unseparated sound list managed by the sound source separation unit 112. If the unseparated sound is not listed in the unseparated sound list (NO in step S108), the processing proceeds to step S109. If the unseparated sound is listed in the unseparated sound list (YES in step S108), the processing proceeds to step S118. In step S118, the sound source separation unit 112 acquires the sound of the frame described in the unseparated sound list from the first storage unit 115.

Next, in step S109, the sound source separation unit 112 executes sound source separation processing. In other words, based on the multi-channel sound collection signal collected in step S105, sound of the divided area is separated in the order of the divided area notified by the allocation space control information. As described above, the sound of the divided area can be reproduced by executing phase control and weighted addition on the sound signals collected by the microphones based on the relationship between the microphones constituting the microphone array 111 and a position of the divided area. The separated sound signal of the divided area is output to the first storage unit 115 and the signal processing unit 113.

Next, in step S110, the sound separated at each divided area is stored in the first storage unit 115.

Next, in step S111, the signal processing unit 113 executes processing on the sound of the divided area. As described above, for example, the processing executed by the signal processing unit 113 may be delay correction processing for correcting an effect caused by a distance between the divided area and the sound collection processing unit 110, gain correction processing, or noise reduction through echo removal processing. The processed sound is output to the first storage unit 115 and the first transmission/reception unit 114.

Next, in step S112, the sound on which signal processing is executed by the signal processing unit 113 is stored in the first storage unit 115.

Next, in step S113, the first transmission/reception unit 114 of the sound collection processing unit 110 transmits the processed sound signal of the divided area to the reproduction signal generation unit 120. The transmitted sound signal is transmitted to the reproduction signal generation unit 120 via the signal transmission path.

In step S114, the second transmission/reception unit 121 of the reproduction signal generation unit 120 receives the sound signal of the divided area. The received sound signal is output to the real-time reproduction signal generation unit 122 and the second storage unit 123.

Next, in step S115, the real-time reproduction signal generation unit 122 executes mixing of sound for real-time reproduction. In the mixing, the signal is combined or converted so as to be reproduced according to the specification of the reproduction device such as the number of channels. The sound on which mixing is executed for real-time reproduction is output to the external reproduction device, or output as a broadcasting signal.

Then, in step S116, the sound of the divided area is stored in the second storage unit 123. The sound signal for replay reproduction is created by using the sound of the divided area stored in the second storage unit 123. Then, the processing is ended.

<Replay Processing>

Next, a flow of processing executed when replay is requested will be described with reference to FIG. 2B. When replay is requested from the user or the external apparatus, in step S121, the replay reproduction signal generation unit 124 reads out the sound signal of the divided area corresponding to replay time from the second storage unit 123.

Next, in step S122, the replay reproduction signal generation unit 124 executes mixing of sound for replay reproduction. The sound mixed for replay reproduction is output to an external reproduction apparatus or output as a broadcasting signal. Then, the processing is ended.

As described above, by controlling the allocation spaces of the plurality of sound collection processing units 110 according to the position of the listening point, sound of the area in a vicinity of the listening point can be processed in time for the real-time reproduction signal generation.

In the present exemplary embodiment, the microphone array 111 configured of microphones has been described as an example. However, the microphone array 111 may be set with a structural object such as a reflection board. Further, microphones used for the microphone array 111 may be omni-directional microphones, directional microphones, or may be mixture of directional and omni-directional microphones.

In the present exemplary embodiment, the first storage unit 115 which entirely stores the sound input from the microphone array 111, the sound separated by the sound source separation unit 112 through sound source separation, and the sound processed by the signal processing unit 113 through signal processing has been described as an example. However, for example, in the actual apparatus, a size of the storable sound data may be limited. Therefore, the sound of the microphone array 111 may be stored only when the division number N is greater than the limit value M at the sound source separation area control unit 116. Further, when a recorded frame number is deleted from the unseparated sound list, sound data corresponding to the recorded frame number may be deleted. With this processing, even in a case where the storage device has a limited capacity, the processing of the microphone array 111 can be smoothed.

Further, in the present exemplary embodiment, as to whether to execute sound source separation processing is determined according to the magnitude of the division number N of the sound collection area and the predetermined area number M. However, a signal processing amount of the CPU or a transmission volume of the signal transmission path may be monitored, so that the number of areas to be processed may be determined while the processing amount or the transmission volume is taken into consideration. Further, the sound source separation may be executed on all of the N-pieces of divided areas in step S109, and the signal processing may be executed up to the M-th divided area in step S111. Alternatively, the signal processing may be executed on all of N-pieces of divided areas, and transmission of the sound signal may be executed up to the M-th divided area in step S113. With this configuration, processing can be smoothed flexibly according to the characteristics of the apparatuses that constitute the system.

In the present exemplary embodiment, the allocation space control unit 125 that divides the space by making the listening point 401 as the center has been described. However, there is a limitation in a distance in which the microphone array 111 can collect sound, and thus the space where the sound collection processing unit 110 can collect sound does not always overlap with each other across the entire region of the sound collection space. For example, in the examples illustrated in FIGS. 4A, 4B, 4C, and 4D, while the sound collection space is divided into six-by-six pieces of divided areas 403, it is assumed that the microphone array 111 can only collect sound of a range corresponding to a region consisting of four-by-four pieces of divided areas 403. Then, in each of FIGS. 4A, 4B, 4C, and 4D, it is assumed that the microphone array 111A can collect sound from a region consisting of four-by-four pieces of divided areas 403 including a divided area 403 at the upper left corner of the sound collection space. In this case, the microphone array 111A cannot collect sound from divided areas 403 in the two columns on the right side of the sound collection space or divided areas 403 in the two rows on the lower side of the sound collection space. Similarly, the microphone array 111B can collect sound from a region including a divided area 403 at the upper right corner of the sound collection space, the microphone array 111C can collect sound from a region including a divided area 403 at the lower left corner of the sound collection space, and the microphone array 111D can collect sound from a region including a divided area 403 at the lower right corner of the sound collection space. In this case, only the microphone array 111A can collect sound from a region consisting of two-by-two pieces of divided areas 403 including the divided area 403 at the upper left corner of the sound collection space. Therefore, in the above-described region, a sound-collectable space of the microphone array 111A of the sound collection processing unit 110A does not overlap with the sound-collectable spaces of the other sound collection processing units 110. Similarly, the sound-collectable spaces of the sound collection processing units 110 do not overlap with each other in the regions consisting of two-by-two pieces of divided areas 403 each of which includes a divided area 403 at the upper right, the lower left, or the lower right corner of the sound collection space.

Accordingly, when the listening point 401 exists in a distance where a certain microphone array 111 (i.e., in FIG. 4C, the microphone array 111A or 111C) cannot collect sound, a small-size allocation space 402D which surrounds the listening point 401 may be set thereto. As described above, by allocating the sound collection processing unit 110 having sufficient resources in a vicinity of the listening point 401, the sound in a vicinity of the listening point 401 can be acquired reliably and precisely, and reproduced faithfully. Further, the sound collection processing unit 110D that is allocated with a small-size allocation space can quickly advance and complete the processing within a short time because a processing amount thereof is small. Further, in this case, by setting a priority level of data transmission between the sound collection processing unit 110D and the reproduction signal generation unit 120 to be high, data can be transmitted to the other sound collection processing units 110 in a short time, so that the sound of higher importance can be reproduced preferentially.

Further, in the present exemplary embodiment, the allocation space control unit 125 divides the space by making the listening point 401 at the center. As described above, because all of the sound collection processing units 110 cannot always collect sound of the entire divided areas, a limitation may be set to a size of the allocation space. Because intensity of the sound signal is attenuated according to an increase in a distance between the sound source and the sound collection device, there is a limitation in a sound-collectable range of the microphone array 111 of the sound collection processing unit 110. Further, resolution of the divided area is lowered when the divided area is distant from the microphone array 111. Thus, by setting the upper limit to a size of the allocation space, it is possible to maintain and ensure the sound collection level and the resolution of the divided area.

Further, the allocation space may be determined according to an orientation of a listener. For example, generally, because the sound in front of the listener is important, processing may be preferentially executed on a front side of the listener by setting a small-size allocation space thereto.

In the present exemplary embodiment, although the allocation space control unit 125 divides the space by making the listening point 401 as a reference, an origin for dividing the space may be determined based on the importance (i.e., evaluation value) of a divided area or a position. For example, by providing an importance setting unit for setting importance of a divided area from a sound level of the most recent several frames of the divided area, the space may be divided in such a manner that divided areas with higher importance are respectively allocated to the sound collection processing units 110 as equally as possible. With this configuration, because processing of regions with higher importance can be equally allocated to the plurality of sound collection processing units 110, it is possible to faithfully reproduce the stereoscopic sound while smoothing the processing load.

Further, if an allocated sound collection processing unit 110 is changed to another sound collection processing unit 110 in the middle of processing with respect to the continuous sound, the user may feel a sense of discomfort because the sound quality or the background sound is changed. Thus, the allocated sound collection processing unit 110 may be prevented from being changed to another sound collection processing unit 110 according to the continuity of sound. In other words, a timing of switching the sound collection processing units 110 for generating a sound signal corresponding to the divided area may be controlled according to the continuity of the sound included in the sound collection signal acquired by the microphone array 111. Further, by providing an image-capturing apparatus having an image-capturing range that covers all or a part of the sound collection space where sound is collected by the plurality of sound collection processing units 110, a predetermined object such as a person is detected from the image captured by the image-capturing apparatus, so that importance is set based on a position of the detected object. For example, a periphery of the person can be determined as a region of higher importance. Further, machine learning using sound or images may be executed previously, so that the importance is set based on a learning result. In this regard, well known machine learning algorithms such as KNN (K-Nearest Neighbors) algorithm may be used.

In the present exemplary embodiment, although the sound source separation unit 112 acquires sound of the divided area through beamforming processing, another sound source separation method may be also used. For example, a power spectral density (PSD) is estimated at each divided area, and sound source separation may be executed through the Wiener filter based on the estimated PSD.

In the present exemplary embodiment, the replay reproduction signal generation unit 124 and the real-time reproduction signal generation unit 122 which execute similar processing have been described as examples. However, the replay reproduction signal generation unit 124 and the real-time reproduction signal generation unit 122 may execute different mixing. For example, different mixing may be executed in real-time reproduction and replay reproduction because virtual listening points thereof are different.

In the present exemplary embodiment, although all of the sound collection processing units 110 have the same configuration, configurations thereof may be different from each other. For example, the microphone arrays 111 may include microphones of different numbers. Further, for example, the reproduction signal generation unit 120 may be realized with a computer identical to one or a plurality of sound collection processing units 110.

Further, for example, processing devises of the sound collection processing units 110 may have different specifications. These specifications may be a processing speed of the CPU, a memory storage capacity, and a specification of a sound signal processing chip. The higher specification may be set with respect to a sound collection processing unit 110X allocated with a space X where the listening point is likely to be generated, and the sound collection processing unit 110X may be allocated with a space wider than the allocation spaces of the other sound collection processing units 110 when the listening point does not exist in the vicinity of the space X.

Figure 4D:
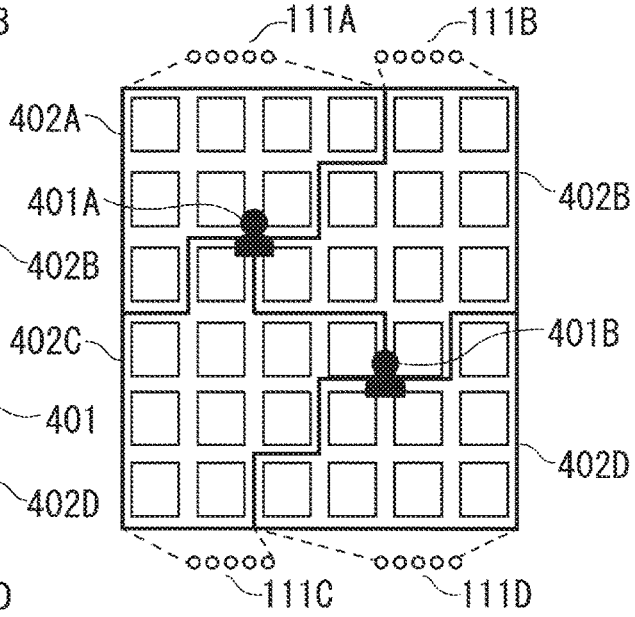

Further, in the present exemplary embodiment, although a single reproduction signal generation unit 120 is provided, the sound system 100 may include at least one or more reproduction signal generation units 120, and the listening points may be respectively set to the plurality of reproduction signal generation units 120. In this case, for example, as illustrated in FIG. 4D, the space is divided in such a manner that the divided areas in the vicinities of the listening points are allocated to the plurality of sound collection processing units 110 as much as possible. In the example illustrated in FIG. 4D, the allocation spaces are allocated in such a manner that the allocation spaces 402A, 402B, and 402C are adjacent to the listening point 401A, and the allocation spaces 402B, 402C, and 402D are adjacent to the listening point 401B.

Further, in the present exemplary embodiment, for the sake of simplicity, although the allocation space control unit 125 controls the allocation of the predetermined divided areas 403, the allocation space control unit 125 may divide the space with boundaries different from the boundaries of the predetermined divided areas 403. In this case, the sound source separation area control unit 116 determines how the allocated space is divided into divided areas, and outputs the determination result to the sound source separation unit 112.

Further, a display device indicating the allocation space may be provided, so that change of allocation spaces in each time may be displayed on the display device, although it is not provided in the present exemplary embodiment in particular. Further, a divided area where sound source separation has not been executed may be displayed. Further, a user interface (UI) which enables the user to select a divided area where sound source separation has not been executed to instruct sound source separation of that divided area may be provided. Further, a UI which enables the user to perform setting of the allocation space to the allocation space control unit 125 may be also provided. For example, as illustrated in FIGS. 7A and 7B, the user may be allowed to specify the allocation space of an optional time by selecting and moving a boundary of the allocation space.

Figure 7A:
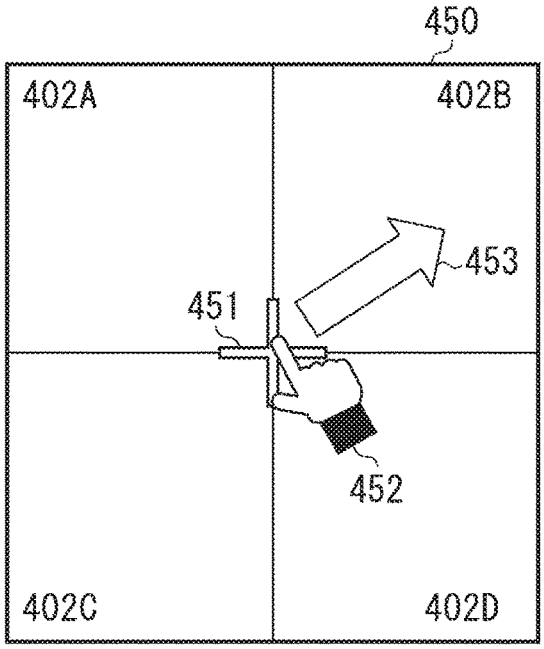
FIGS. 7A and 7B are diagrams illustrating a user interface (UI) for setting an allocation space.
Figure 7B:
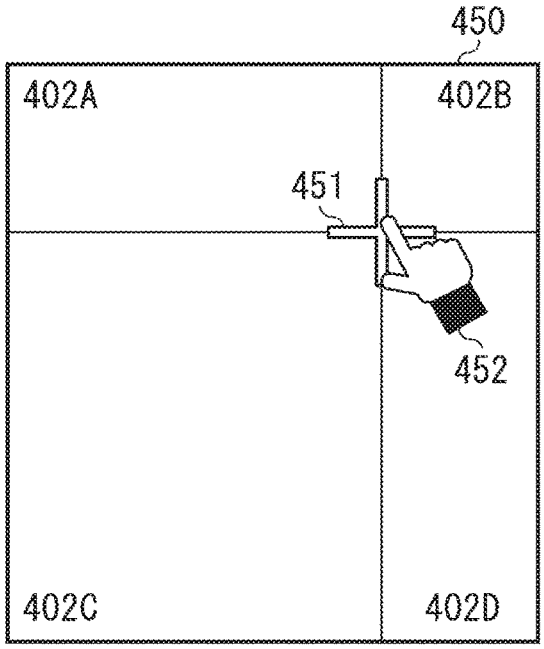

FIGS. 7A and 7B are diagrams illustrating an example of a UI for the user to select an allocation space. In FIG. 7A or 7B, a sound collection space 450 is displayed on the display device. An index 451 serves as a reference for the user to determine allocation of the allocation space, and the user can select the index 451 through a pointer of a pointing device or a touch panel. When the user selects the index 451, the sound system 100 divides the sound collection space 450 into four allocation spaces 402A, 402B, 402C, and 402D with a horizontal line and a vertical line passing through the index 451 (see FIG. 7A). When the user moves the index 451 in a certain direction (e.g., direction 453), the sound system 100 moves the horizontal line and the vertical line passing through the index 451 accordingly, so that regions specified as the allocation spaces 402A, 402B, 402C, and 402D are changed (see FIG. 7B). Accordingly, the user can easily divide the sound collection space into desired regions by simply selecting the index 451.

In the above-described first exemplary embodiment, the allocation spaces allocated to the respective microphone arrays 111 (sound collection processing units 110) have been adjusted based on the listening point. In a second exemplary embodiment, the allocation spaces allocated to respective microphone arrays 111 are adjusted by determining the area important for reproducing sound based on image-capturing information.

<Image-Capturing System>

Figure 8:
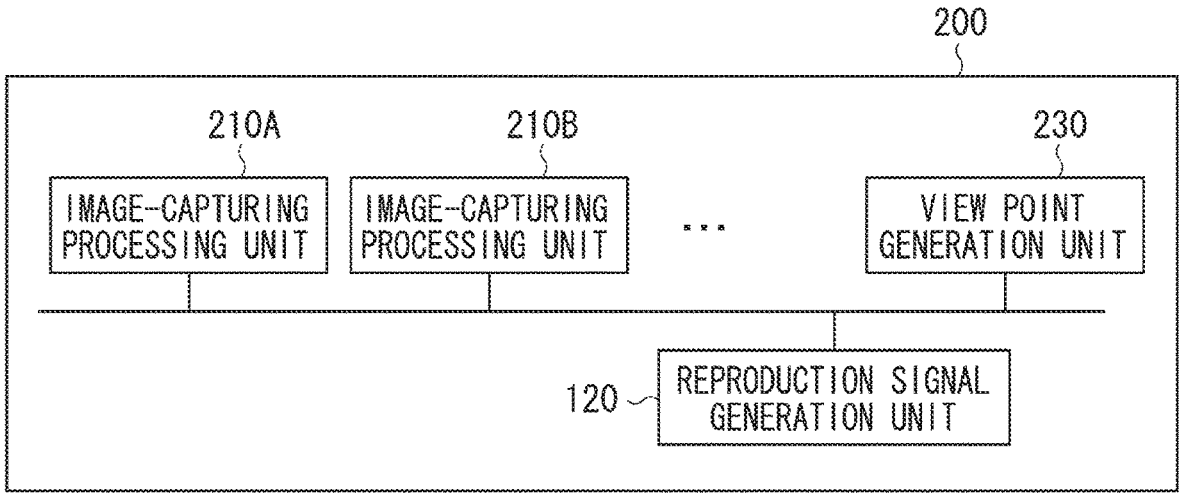
FIG. 8 is a block diagram illustrating a configuration of an image-capturing system.

FIG. 8 is a block diagram illustrating a configuration of an image-capturing system 200. The image-capturing system 200 includes a plurality of image-capturing processing units 210, a reproduction signal generation unit 120, and a view point generation unit 230. The plurality of image-capturing processing units 210, the reproduction signal generation unit 120, and the view point generation unit 230 mutually transmit and receive data through a wired or a wireless transmission path.

<Image-Capturing Processing Unit>

Figure 9:
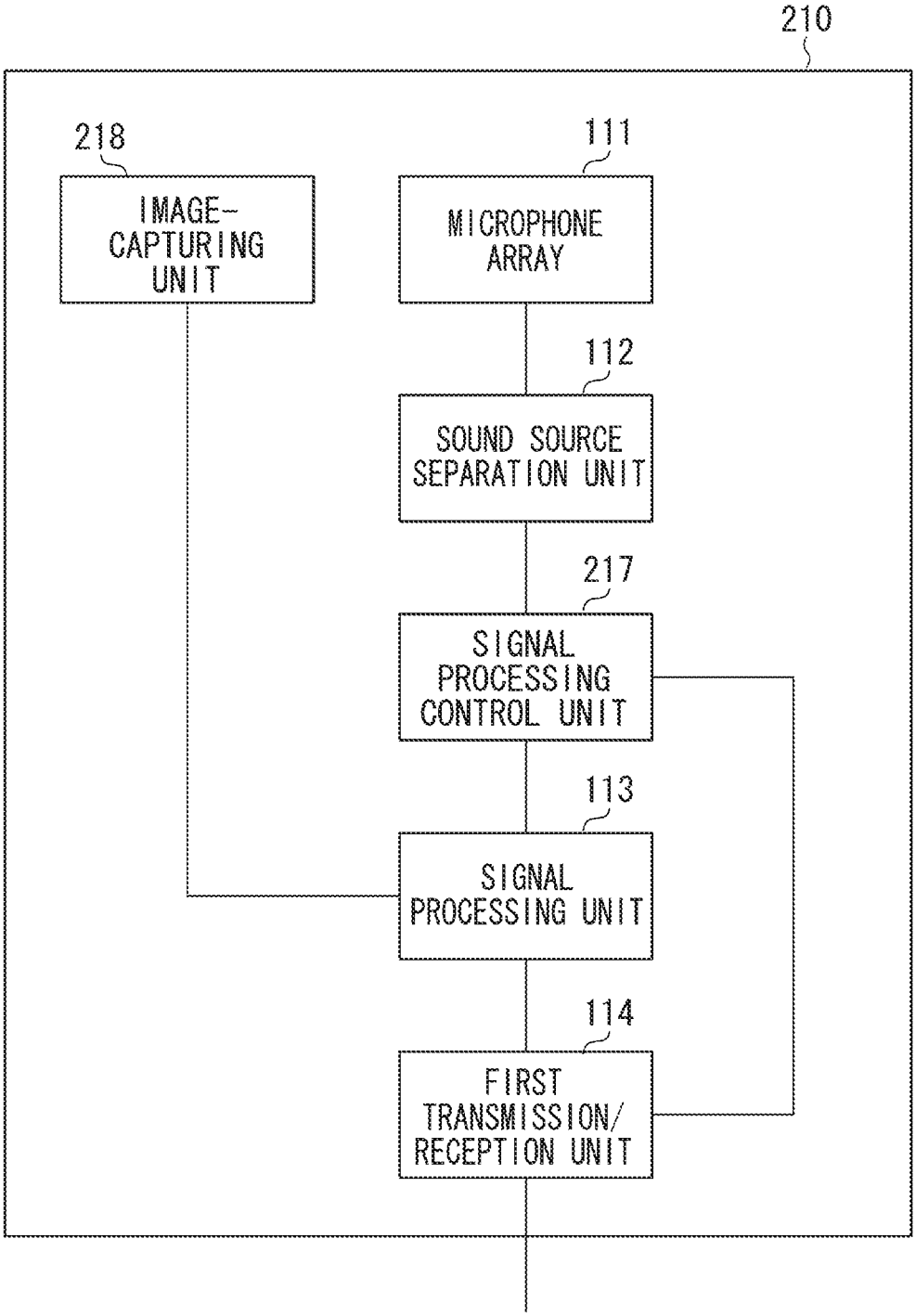
FIG. 9 is a block diagram illustrating a configuration of an image-capturing processing unit.

FIG. 9 is a block diagram illustrating a configuration of the image-capturing processing unit 210. The image-capturing processing unit 210 includes a microphone array 111, a sound source separation unit 112, a signal processing control unit 217, a signal processing unit 113, a first transmission/reception unit 114, and an image-capturing unit 218.

Configurations of the microphone array 111, the sound source separation unit 112, and the first transmission/reception unit 114 are similar to those described in the first exemplary embodiment with reference to FIG. 2, and thus detailed description thereof will be omitted. The signal processing unit 113 executes processing with respect to image data captured by the image-capturing unit 218 in addition to the sound signal processing described in the first exemplary embodiment. For example, the signal processing unit 113 executes noise reduction processing.

Based on the information about processing allocation input from the first transmission/reception unit 114, the signal processing control unit 217 outputs a sound signal of the divided area to the signal processing unit 113 or the first transmission/reception unit 114. The image-capturing unit 218 is an image-capturing apparatus such as a video camera for capturing an image, so that an image including at least a space allocated to the image-capturing processing unit 210 is captured thereby. The captured image is output to the signal processing unit 113.

<Reproduction Signal Generation Unit>

Figure 10:
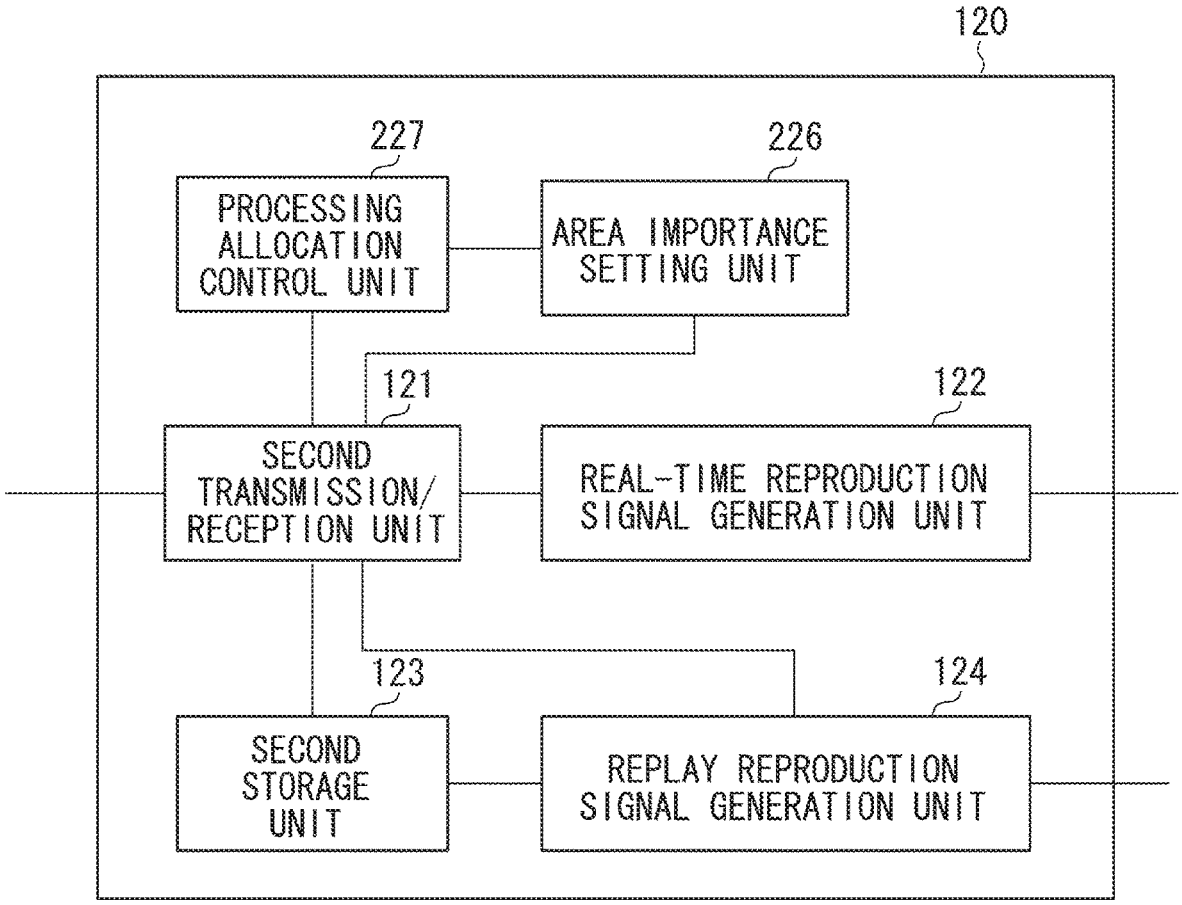
FIG. 10 is a block diagram illustrating a configuration of the reproduction signal generation unit.

FIG. 10 is a block diagram illustrating a configuration of the reproduction signal generation unit 120. The reproduction signal generation unit 120 includes a second transmission/reception unit 121, a real-time reproduction signal generation unit 122, a second storage unit 123, a replay reproduction signal generation unit 124, an area importance setting unit 226, and a processing allocation control unit 227.

In the present exemplary embodiment, the second transmission/reception unit 121 and the second storage unit 123 execute transmission and storage of the image captured by the image-capturing processing unit 210 in addition to the processing described in the first exemplary embodiment with reference to FIG. 3. Configurations other than the above are basically the same as the configurations of the first exemplary embodiment, and thus detailed description thereof will be omitted.

The real-time reproduction signal generation unit 122 switches the images transmitted from a plurality of image-capturing processing units 210 according to a viewpoint generated by the view point generation unit 230 described below, and generates a video image signal for real-time reproduction. Further, the real-time reproduction signal generation unit 122 executes mixing of a sound source by making a viewpoint as a listening point. The real-time reproduction signal generation unit 122 outputs generated video image and the sound.

When replay reproduction is requested, the replay reproduction signal generation unit 124 acquires data of corresponding time from the second storage unit 123, and executes processing similar to the processing executed by the real-time reproduction signal generation unit 122 to output the data.

The area importance setting unit 226 acquires the images transmitted from the image-capturing processing units 210 from the second transmission/reception unit 121. The area importance setting unit 226 detects an object that can be a sound source from the images, and sets the area importance based on the number of objects in the divided area. For example, the area importance setting unit 226 executes human detection and sets higher importance to a divided area including many specific objects such as persons. The importance set to the divided areas is output to the processing allocation control unit 227.

The processing allocation control unit 227 determines allocation of processing of the image-capturing processing units 210 based on the importance of the divided areas input thereto. For example, the processing allocation control unit 227 determines the allocation in such a manner that divided areas for executing sound processing are reduced with respect to the image-capturing processing unit 210 allocated with the allocation space of higher area importance, and processing of less important divided areas in that allocation space is allocated to another image-capturing processing unit 210.

Figure 11A:
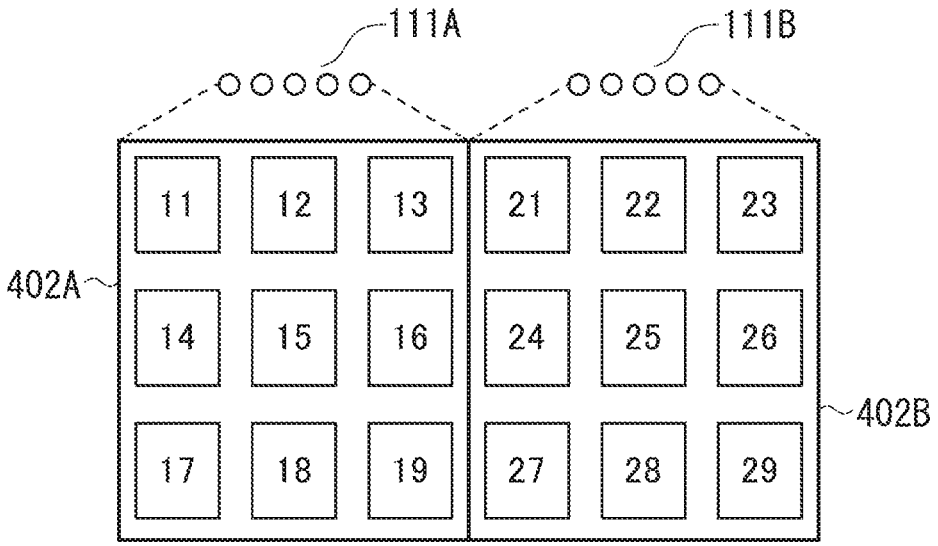
FIGS. 11A and 11B are diagrams illustrating processing allocation control.
Figure 11B:
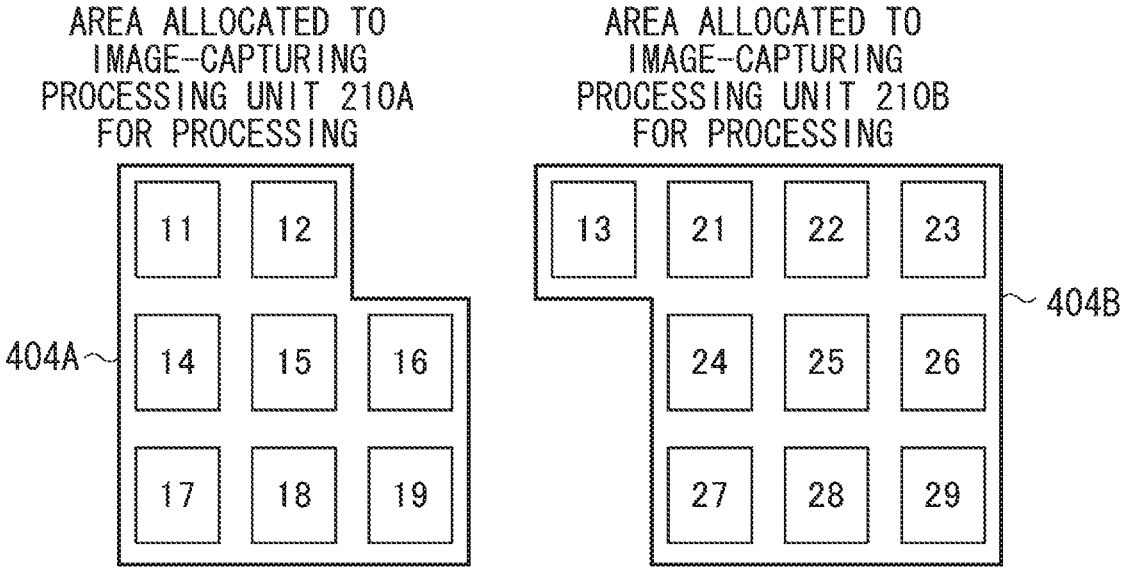

For example, as illustrated in FIG. 11A, it is assumed that allocation spaces 402A and 402B are respectively allocated to the microphone arrays 111A and 111B of two image-capturing processing units 210A and 210B, while the allocation spaces 402A and 402B respectively include divided areas 11 to 19 and 21 to 29. Herein, if the area importance setting unit 226 sets the divided area 17 as an important area, the processing allocation control unit 227 allocates the divided areas so as to reduce the processing amount of the image-capturing processing unit 210A that covers the divided area 17. More specifically, a part of the divided areas 11 to 19 initially allocated to the image-capturing processing unit 210A is allocated to another image-capturing processing unit 210. For example, as illustrated in FIG. 11B, signal processing of sound corresponding to the divided area 13 is allocated to the image-capturing processing unit 210B. In other words, the image-capturing processing unit 210A covers divided areas included in a space 404A, whereas the image-capturing processing unit 210B covers divided areas included in a space 404B.

As described above, a part of the signal processing which is to be executed by the image-capturing processing unit 210A having many divided areas of higher importance is allocated to the image-capturing processing unit 210B having less divided areas of higher importance. Further, the processing allocation control unit 227 allocates processing so as not to unevenly allocate the processing to a part of the image-capturing processing units 210. For example, when the processing is to be allocated continuously, the processing is allocated to different image-capturing processing unit 210 at each frame. With this configuration, a processing load of the image-capturing processing unit 210 covering the divided area of higher importance can be reduced, so that the sound in the important divided area can be reproduced reliably.

For example, the view point generation unit 230 includes a camera image switching unit (switcher) and a received image display device, so that the user can select an image to be used while looking at the images from the image-capturing units 218 of the plurality of image-capturing processing units 210. A position and an orientation of the image-capturing unit 218 that captures the selected image are regarded as viewpoint information. The view point generation unit 230 outputs a generated viewpoint and time corresponding to that viewpoint. Herein, time information is information indicating in what timing the viewpoint exists in that position and orientation, and it is desirable that the time information conform to time information of the image and the sound.

<Signal Generation Processing>

Figure 12A:
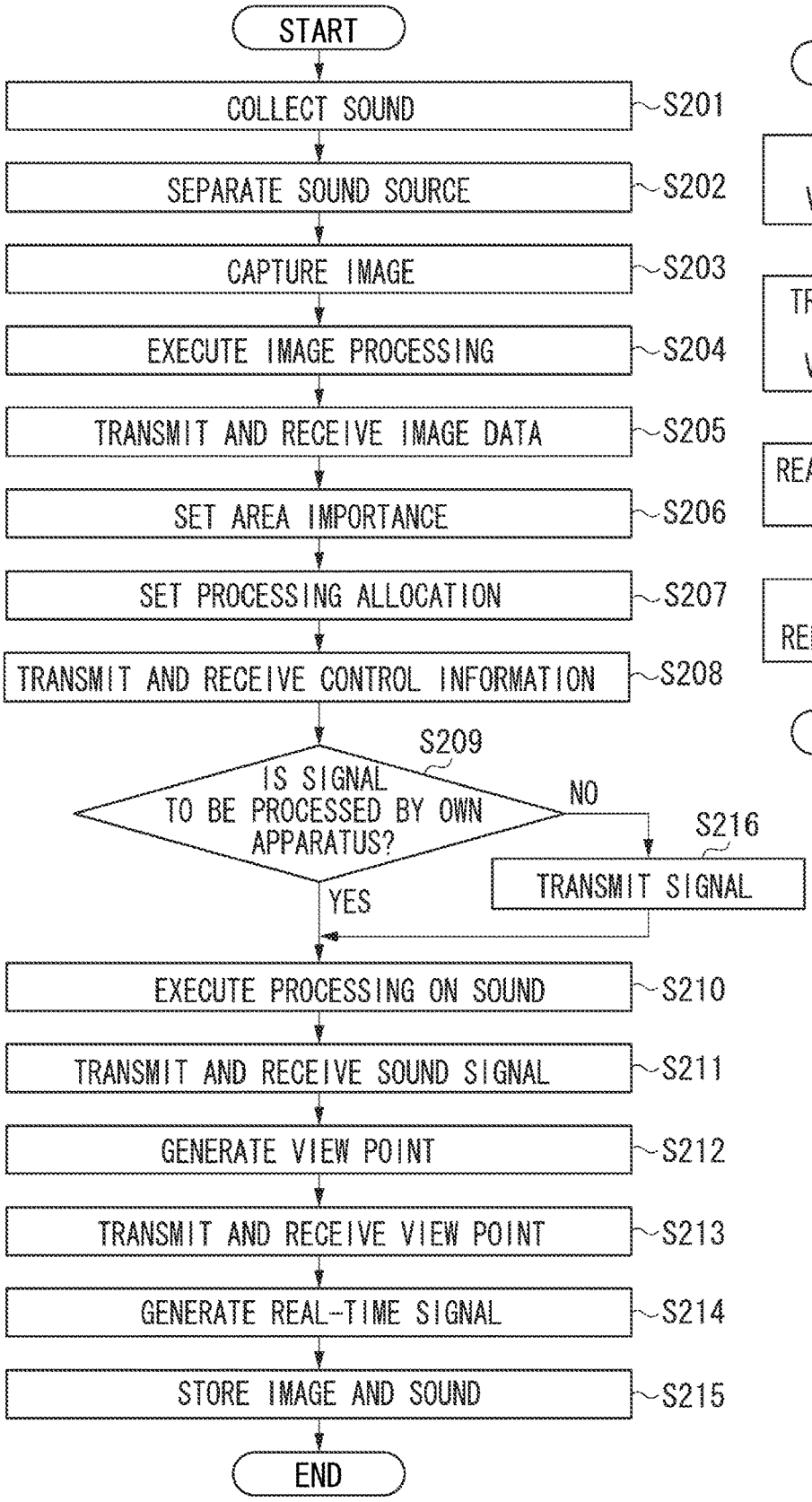
FIGS. 12A and 12B are flowcharts illustrating processing executed by the image-capturing system.

FIG. 12A is a flowchart illustrating a processing procedure of processing for collecting sound and generating a real-time reproduction signal (signal generation processing) of the present exemplary embodiment.

The processing of sound collection in step S201 and the processing of sound source separation in step S202 are similar to the processing executed in steps S105 and S109 of the first exemplary embodiment, and thus detailed description thereof will be omitted.

In step S203, the image-capturing unit 218 of the image-capturing processing unit 210 captures an image of the space. The captured image is output to the signal processing unit 113.

Next, in step S204, the signal processing unit 113 executes image processing. More specifically, processing such as optical correction is executed based on a positional relationship between the divided area and the sound collection processing unit 110. The processed image is transmitted to the first transmission/reception unit 114.

Next, in step S205, the first transmission/reception unit 114 transmits image data, so that the image data is received by the second transmission/reception unit 121 of the reproduction signal generation unit 120 and the view point generation unit 230. The image data received by the second transmission/reception unit 121 of the reproduction signal generation unit 120 is output to the area importance setting unit 226, the real-time reproduction signal generation unit 122, and the second storage unit 123. Further, the image data received by the view point generation unit 230 is displayed on the received image display device.

Next, in step S206, the area importance setting unit 226 sets importance of the divided areas. As described above, importance of the divided areas is determined based on the number of persons captured in the divided areas by analyzing the captured images of the divided areas. The importance set to the divided areas is transmitted to the processing allocation control unit 227.

In step S207, the processing allocation control unit 227 determines allocation of the sound signal processing with respect to the image-capturing processing units 210. The control information indicating determined processing allocation is output to the second transmission/reception unit 121.

Next, in step S208, the control information indicating the processing allocation is transmitted from the second transmission/reception unit 121 and received by the first transmission/reception unit 114 of the image-capturing processing unit 210. The control information of the processing allocation received by the first transmission/reception unit 114 is output to the signal processing control unit 217.

Then, in step S209, based on the received control information, the signal processing control unit 217 determines whether the signal of the divided area is a signal to be processed by the signal processing unit 113 of the own image-capturing processing unit 210 or a signal to be processed by another image-capturing processing unit 210. If the signal is to be processed by the own image-capturing processing unit 210 (YES in step S209), the processing proceeds to step S210.

If the signal is to be processed by another image-capturing processing unit 210 (NO in step S209), the processing proceeds to step S216. In step S216, the first transmission/reception unit 114 of the own image-capturing processing unit 210 transmits the signal to the first transmission/reception unit 114 of the corresponding image-capturing processing unit 210. The received sound signal of the divided area is output to the signal processing control unit 217.

Next, in step S210, the signal processing unit 113 executes processing of the sound signal. In step S210, similar to the processing in step S111 of FIG. 6A, for example, delay correction processing for correcting an effect caused by a distance between the divided area and the sound collection processing unit 110, gain correction processing, or noise reduction through echo removal processing is executed. The processed sound signal is output to the first transmission/reception unit 114.

Then, in step S211, the first transmission/reception unit 114 transmits the processed sound signal of the divided area to the second transmission/reception unit 121. The sound signal of the divided area received by the second transmission/reception unit 121 is output to the real-time reproduction signal generation unit 122 and the second storage unit 123.

Next, in step S212, a viewpoint is generated by the view point generation unit 230. The generated viewpoint and time information are transmitted to the reproduction signal generation unit 120.

In step S213, the second transmission/reception unit 121 receives the viewpoint and corresponding time information.

The received viewpoint and the time information are output to the real-time reproduction signal generation unit 122.

Next, in step S214, the real-time reproduction signal generation unit 122 generates the real-time reproduction signal. Based on the viewpoint information generated by the view point generation unit 230, the real-time reproduction signal generation unit 122 selects one image from images captured in a plurality of viewpoints, and executes mixing of the sound source according to the viewpoint of that selected image. Temporal synchronization is executed on the image and the sound, and the image and the sound are output as video image information with sound.

Lastly, in step S215, the second storage unit 123 stores all of the images and sound signals received by the second transmission/reception unit 121. Then, the processing is ended.

<Replay Processing>

Figure 12B:
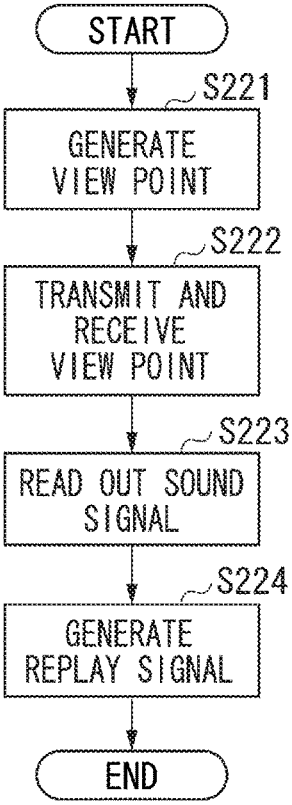

FIG. 12B is a flowchart illustrating a processing flow of replay reproduction signal generation. First, in step S221, during or after the image-capturing period, the view point generation unit 230 generates a past-time viewpoint used for replay processing.

In step S222, the generated viewpoint and time information corresponding to the viewpoint are transmitted to the second transmission/reception unit 121. The viewpoint and the time information received by the second transmission/reception unit 121 are transmitted to the replay reproduction signal generation unit 124.

Next, in step S223, the replay reproduction signal generation unit 124 reads out the image corresponding to the time and the viewpoint and the sound corresponding to the time from the second storage unit 123.

Then, in step S224, the replay reproduction signal generation unit 124 generates a replay signal. The processing in step S224 is similar to the processing in step S214, so that description thereof will be omitted.

As described above, importance is determined for each divided area, and a space (divided area) where the image-capturing processing unit 210 executes processing is controlled based on the importance. Therefore, the divided area of higher importance can be processed preferentially, so that the sound can be processed in time for real-time reproduction.

In the present exemplary embodiment, although the plurality of image-capturing processing units 210 having similar performance has been described, the performance thereof may be different from each other. For example, performance of the image-capturing units 218 may be different.

In the present exemplary embodiment, although the image-capturing system 200 having a single view point generation unit 230 and a single reproduction signal generation unit 120 has been described as an example, the view point generation unit 230 and the reproduction signal generation unit 120 may be provided more than one. However, in this case, any one of the area importance setting units 226 and processing allocation control units 227 becomes functional.

In the present exemplary embodiment, although an exemplary embodiment in which only signal processing of sound is executed by another image-capturing processing unit 210 has been described, signal processing of a captured image may be executed together. In the present exemplary embodiment, although the microphone array 111 and the sound source separation unit 112 are used for collecting sound of the divided area, the sound may be acquired by arranging an omni-directional microphone at an approximately central portion of the set divided area. In the present exemplary embodiment, although a processing order of the signal processing unit 113 is not set in particular, the processing may be executed in an order from a divided area of the highest area importance based on the area importance set by the area importance setting unit 226.

In the present exemplary embodiment, although the area importance setting unit 226 sets the area importance according to the number of objects included in the divided area acquired from the image, another information may be also used. For example, the importance may be determined from sound, or may be determined by using a sound volume or a sound recognition result of the divided area. Further, the importance may be set by an operation of the user, or processing of automatically determining the importance from an input image and sound may be executed by previously learning data of the past image and sound. Alternatively, the importance of a divided area may be set according to an estimated position of the object by using a device for estimating the movement of the object.

In the present exemplary embodiment, the processing allocation control unit 227 allocates processing based on the area importance. However, for example, a load detection device for monitoring a processing load of the image-capturing processing unit 210 may be provided, so that the processing allocation control unit 227 allocates the processing in such a manner that the processing to be executed by the image-capturing processing units 210 is smoothed according to the processing loads. Further, data has to be transmitted to another image-capturing processing unit 210 when the processing is allocated. Thus, there is a possibility that a load of the signal transmission path is increased. Therefore, a data transmission amount may be reduced by monitoring a transmission load of the signal transmission path and adjusting the processing allocation according to the load status.

In the present exemplary embodiment, although a storage device is not provided on the image-capturing processing unit 210, a storage device which stores data when processing cannot be executed in time because of processing allocation may be provided.

In the present exemplary embodiment, although the processing allocation control unit 227 allocates the processing based on the area importance, the importance does not have to be specified by the divided area. For example, the importance may be specified by the coordinates of a certain point in the space. The importance may be set at each of the allocation spaces of the image-capturing processing units 210, and processing allocation may be controlled based on the set importance.

In the present exemplary embodiment, although a camera image switching unit is used for the view point generation unit 230, the view point generation unit 230 may be a device for inputting an orientation and a locus of a camera in the space. For example, when the image switching unit is used, a locus of the camera takes a discrete value that is dependent on a position of the camera. However, the view point generation unit 230 may be a unit that generates a free viewpoint in the space which is changed continuously.

In the present exemplary embodiment, a virtual listening point is taken as a viewpoint, a virtual listening point specification device which allows a user to specify a virtual listening point may be provided, so that the processing is executed according to the input thereof.

Further, display control in which an image illustrating an implementation status of processing allocation is displayed on the display device may be executed although description thereof is omitted in the present exemplary embodiment.

Figure 13B:
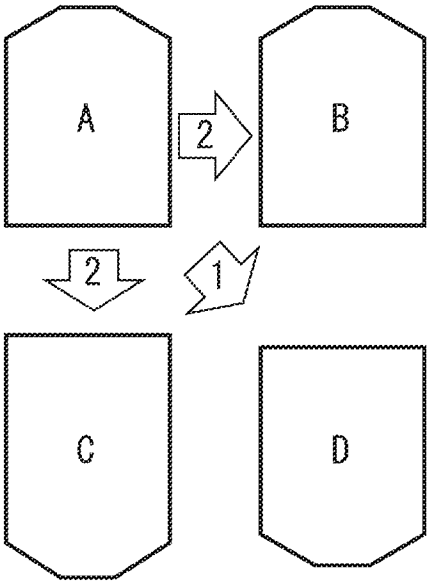
FIGS. 13A and 13B are diagrams illustrating display examples of processing allocation.
Figure 13A:
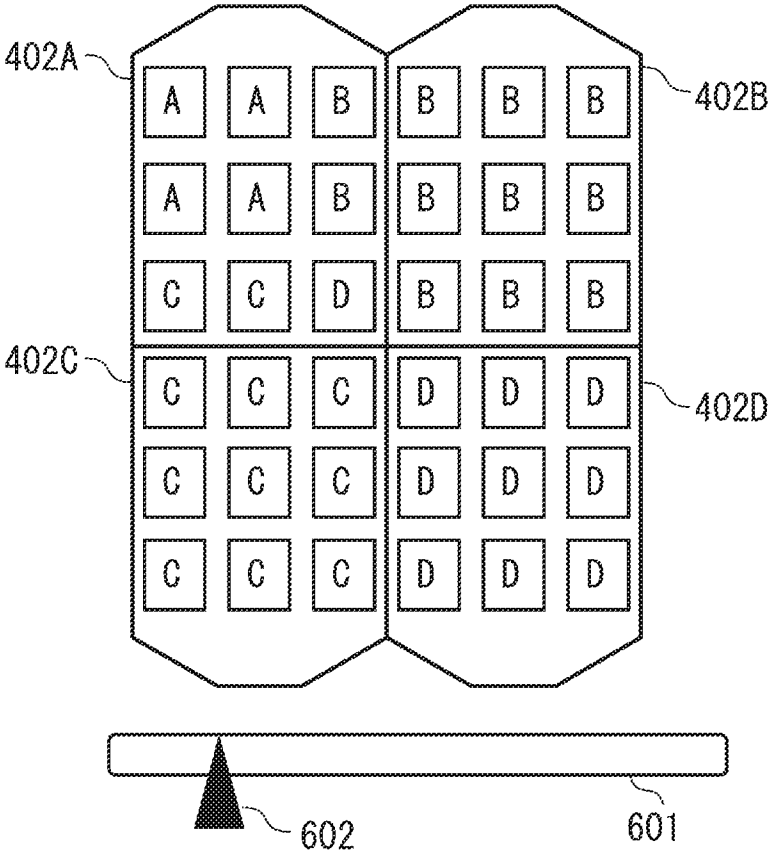

FIGS. 13A and 13B are diagrams illustrating examples of the screens displayed on the display device. For example, in FIG. 13A, allocation spaces 402A to 402D and divided areas therein are displayed on the display screen. A time bar 601 represents a recording time up to the present time, and a position of a time cursor 602 represents time of the display screen. Information about by which image-capturing processing unit 210 the sound of respective divided areas is processed is displayed thereon. In this example, the allocation spaces 402A to 402D are allocated to the image-capturing processing units 210A to 210D, and a display which illustrates allocation of the processing is provided. The above display may be provided in different colors. Further, a user interface may be provided so that a user can specify the image-capturing processing unit 210 to which the processing is allocated by selecting a divided area displayed on the display screen.

Alternatively, as illustrated in FIG. 13B, with respect to the allocation spaces 402A to 402D, signal processing of how many divided areas is allocated to which image-capturing processing units 210 may be simply illustrated. In this case, it is preferable that the user be allowed to adjust the number of divided areas allocated to the image-capturing processing units 210. Further, a viewpoint of real-time reproduction or replay reproduction and a position of the object may be displayed on the display screen in an overlapping manner. Further, the above-described entire area display may be displayed on the image of the actual space in an overlapping manner.

As described above, according to the exemplary embodiments of the present invention, even in the real-time reproduction in which sound has to be reproduced within a limited time period, reproduction can be executed without losing the important sound by controlling the allocation of the sound collection devices that collect sound of the areas.

Other Exemplary Embodiments

The present invention can be realized in such a manner that a program for realizing one or more functions according to the above-described exemplary embodiments is supplied to a system or an apparatus via a network or a storage medium, so that one or more processors in the system or the apparatus reads and executes the program. Further, the present invention can be also realized with a circuit (e.g., application specific integrated circuit (ASIC)) that realizes one or more functions.

According to the above-described exemplary embodiments, it is possible to provide a technique of efficiently executing processing in a configuration in which a reproduction signal is generated by acquiring sound from a plurality of divided areas in a space.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-208844, filed Oct. 25, 2016, which is hereby incorporated by reference herein in its entirety.

What is claimed is:

1. A sound processing system comprising:

a plurality of signal processing apparatuses configured to generate a plurality of regional sound signals corresponding respectively to a plurality of divided areas included in a target area, based on at least one collected sound signal acquired by collecting sounds in the target area with at least one microphone, wherein a number of the plurality of divided areas is larger than a number of the plurality of signal processing apparatuses; and a control apparatus configured to perform:

obtaining listening point information indicating a position of a virtual listening point in the target area, wherein an audio signal for playback is generated based on the position of the virtual listening point and at least a part of the plurality of regional sound signals; and changing, based on the obtained listening point information, an allocation of generation processing for generating the plurality of regional sound signals to the plurality of signal processing apparatuses.

2. The sound processing system according to claim 1, wherein the plurality of signal processing apparatuses generate the plurality of regional sound signals based on collected sound signals acquired by microphone arrays that respectively correspond to the plurality of signal processing apparatuses, wherein each of the microphone arrays is composed of at least one microphone.

3. The sound processing system according to claim 2, wherein at least a part of a first sound collection area of one microphone array included in the microphone arrays overlaps with a second sound collection area of another microphone array included in the microphone arrays.

4. The sound processing system according to claim 3, wherein the control apparatus is configured to further perform:

allocating generation processing for generating a regional sound signal corresponding to a divided area, which is included in an overlap area where the first sound collection area and the second sound collection area overlap, to a signal processing apparatus selected based on the obtained listening point information from the plurality of signal processing apparatus.

5. The sound processing system according to claim 1, wherein the control apparatus is configured to further perform:

setting a priority with respect to a divided area included in the plurality of divided areas, and determining, based on the set priority, a generation order of one or more regional sound signals to be generated by a signal processing apparatus.

6. The sound processing system according to claim 1, wherein the control apparatus is configured to further perform:

determining, based on the obtained listening point information indicating a position of a virtual listening point, at least one of the plurality of signal processing apparatuses to be used for generating a regional sound signal corresponding to a divided area, for each of the plurality of the divided areas.

7. The sound processing system according to claim 6, wherein different signal processing apparatuses respectively generate regional sound signals corresponding to different divided areas located in a vicinity of the listening point.

8. The sound processing system according to claim 1, wherein the one or more divided areas corresponding respectively to one or more regional sound signals to be generated by a signal processing apparatus are determined based on a listening direction of the virtual listening point.

9. The sound processing system according to claim 1, wherein the control apparatus is configured to further perform:

setting an evaluation value with respect to a divided area included in the plurality of divided areas, wherein one or more divided areas corresponding respectively to one or more regional sound signals to be generated by a signal processing apparatus are determined based on the set evaluation value.

10. The sound processing system according to claim 9, wherein the setting is performed based on a position of a predetermined object in a captured image acquired by capturing a region including at least a part of the target area.

11. The sound processing system according to claim 9, wherein the setting is performed based on a result of machine learning processing or based on an operation of a user.

12. The sound processing system according to claim 1, wherein the control apparatus is configured to further perform control so that a signal processing apparatus to be used for generating a regional sound signal corresponding to a divided area is switched at a timing determined according to continuity of a collected sound signal acquired by the collecting sounds.

13. The sound processing system according to claim 1, wherein the one or more divided areas corresponding respectively to the one or more regional sound signals to be generated by a signal processing apparatus are determined based on processing loads of the signal processing apparatus.

14. The sound processing system according to claim 1, wherein the control apparatus is configured to further perform:

display control to display an image illustrating a result of the determining.

15. The sound processing system according to claim 1, wherein the control apparatus is configured to further perform:

generating the audio signal for playback based on the position of the virtual listening point and at least a part of the plurality of regional sound signals generated by the plurality of signal processing apparatuses according to the determining.

16. The sound processing system according to claim 1, wherein the plurality of signal processing apparatuses generates the plurality of regional sound signals by executing beamforming processing or processing using a Wiener filter on collected sound signals acquired by the collecting sounds.

17. The sound processing system according to claim 1, wherein the control apparatus is configured to further perform notifying a signal processing apparatus of a divided area to be allocated to the signal processing apparatus.

18. A sound processing method comprising:

generating, by a plurality of signal processing apparatuses, a plurality of sound signals corresponding respectively to a plurality of divided areas included in a target area based on at least one collected sound signal acquired by collecting sounds in the target area with at least one microphone, wherein a number of the plurality of divided areas is larger than a number of the plurality of signal processing apparatuses;

obtaining listening point information indicating a position of a virtual listening point in the target area, wherein an audio signal for playback is generated based on the position of the virtual listening point and at least a part of the plurality of regional sound signals; and changing, based on the obtained listening point information, an allocation of generation processing for generating the plurality of regional sound signals to the plurality of signal processing apparatuses.

19. A control apparatus comprising:

one or more hardware processors; and a memory which stores instructions executable by the one or more hardware processors to cause the control apparatus to perform at least:

obtaining listening point information indicating a position of a virtual listening point in a target area, wherein an audio signal for playback is generated based on the position of the virtual listening point and at least a part of a plurality of regional sound signals corresponding respectively to a plurality of divided areas included in the target area, and wherein the plurality of regional sound signals are generated by a plurality of signal processing apparatuses based on at least one collected sound signal acquired by collecting sounds in the target area with at least one microphone, and wherein a number of the plurality of divided areas is larger than a number of the plurality of signal processing apparatuses; and changing, based on the obtained listening point information, an allocation of generation processing for generating the plurality of regional sound signals to the plurality of signal processing apparatuses.

20. The control apparatus according to claim 19, wherein the one or more hardware processors are configured to further perform:

determining, based on the obtained listening point information indicating a position of a virtual listening point, at least one of the plurality of signal processing apparatuses to be used for generating a regional sound signal corresponding to a divided area, for each of the plurality of the divided areas.

21. A non-transitory computer-readable storage medium storing a program that causes a computer to execute a sound processing method, the sound processing method comprising:

obtaining listening point information indicating a position of a virtual listening point in a target area, wherein an audio signal for playback is generated based on the position of the virtual listening point and at least a part of a plurality of regional sound signals corresponding respectively to a plurality of divided areas included in the target area, and wherein the plurality of regional sound signals are generated by a plurality of signal processing apparatuses based on at least one collected sound signal acquired by collecting sounds in the target area with at least one microphone, and wherein a number of the plurality of divided areas is larger than a number of the plurality of signal processing apparatuses; and changing, based on the obtained listening point information, an allocation of generation processing for generating the plurality of regional sound signals to the plurality of signal processing apparatuses.

* * * * *